United States Patent [19]

Rasmussen

[11] Patent Number: 4,779,871

[45] Date of Patent: Oct. 25, 1988

[54] GAME FOR FORETELLING PARTICULARS OF A PERSON

[76] Inventor: Claudia M. Rasmussen, 11616 Negly, San Diego, Calif. 92131

[21] Appl. No.: 918,987

[22] Filed: Oct. 15, 1986

[51] Int. Cl.[4] ..... A63F 9/00

[52] U.S. Cl. ..... 273/161; 273/1 R

[58] Field of Search ..... 273/1 R, 161; 434/267, 434/273

[56] References Cited

U.S. PATENT DOCUMENTS

| | | | |
|---|---|---|---|
| 230,000 | 7/1880 | Greey | 273/153 R |
| 2,959,891 | 11/1960 | Barnett et al. | 434/267 X |
| 3,213,550 | 10/1965 | Kittner | 434/273 |
| 4,030,736 | 6/1977 | Petrusek | 273/345 |

OTHER PUBLICATIONS

The Complete Book of Games by Wood & Goddard, publ. by Doubleday & Co., Garden City, NY, copyright 1940, p. 586.

*Primary Examiner*—Anton O. Oechsle

*Attorney, Agent, or Firm*—Knobbe, Martens, Olson & Bear

[57] ABSTRACT

A game and method for foretelling particulars such as characteristics and future circumstances of a person, wherein a plurality of indicators are placed by participants, with their vision temporarily impaired, on a display device having a representation of a person therein. The predicted particulars which the selected person will have are those represented by or written upon the indicator positioned closest to a designated location on the display device. In one preferred embodiment, the game and method are used to predict the gender and date of birth of a baby. In that embodiment, the gender of the baby is predicted as the gender represented by the indicator which has been placed closest to a designated location on the display device with a representation of a baby thereon, and the birth date of the baby is predicted as the birth date that was previously written on that same indicator.

14 Claims, 1 Drawing Sheet

GAME FOR FORETELLING PARTICULARS OF A PERSON

BACKGROUND OF THE INVENTION

This invention relates to a game, and more particularly to a game for foretelling particulars of a human subject and of the subject's future, such as what the gender of a baby will be.

There is often speculation at baby showers as to what will be the characteristics, attributes and future particulars of the unborn child. For example, guests often enjoy predicting things such as gender, date of birth, birth weight, talents, interests and other characteristics which the baby will have. For speculative and entertainment purposes, a number of methods may be used at baby showers to foretell particulars such as what the gender of the baby will be. For example, a fortune teller with a crystal ball may look into the pregnant mother's future in order to foretell whether her baby will be a boy or a girl, when it will be born, what its future profession will be, and the like. Alternatively, a mystic card reader may foretell such things by the order in which playing cards are overturned. A palm reader may accomplish the same by examining the lines on the pregnant mother's hand.

These methods, while adequate for producing a prediction as to characteristics such as the baby's gender, tend to lack excitement and do not invite the active participation of the baby shower guests, making them fell left out.

Other methods of foretelling such personal and physical characteristics and future events, and which invite a limited amount of guest participation may be used. For example, one of the guests may place a stethoscope on the pregnant mother's stomach in order to detect the heartbeat of the fetus. It has been found that the heartbeat rate may be indicative of the fetus' gender. Also, some of the guests may play a game sold under the trademark OUIJA. In this game, the participants close their eyes, and think of a question such as, "What will be the gender of this baby?", while placing their hands on a travelling game piece which rests on the game board. Letters of the alphabet are printed on the game board along with other symbols and words. The game board has a relatively smooth surface, and the travelling game piece has a relatively low coefficient of friction so that the pressure of the participants' hands on the game piece causes the piece to travel around the board. Each time the game piece stops, the participants note the letter, word, or symbol over which the game piece is positioned. The repeated positioning of the game piece over various letters of the alphabet on the game board might spell out the words "male" or "female," and thus foretell the gender of the baby. Methods such as those described above are also used at parties to predict future events in a person's life.

While these methods invite a limited amount of guest participation, they also tend to provide only limited excitement and entertainment.

SUMMARY OF THE INVENTION

This invention provides a fun, hilarious, exciting, and titillating game and method for foretelling particulars of a subject person, such as physical and personal characteristics of an unborn baby, and/or future events in the life of the baby or other selected person. The game and method invite the participation of many players and allow each player to become personally involved in predicting particulars such as whether the baby will be a boy or a girl, and what the date of birth will be.

One aspect of one preferred embodiment of the invention provides a method of foretelling what the gender of a baby will be by the placement of a plurality of gender indicators on a display means by a plurality of participants. The method includes providing a display device having a representation of a baby thereon, and positioning this display device to receive placement of a plurality of gender indicators. Next, a first game participant selects a gender indicator which represents either the male or the female gender and then places the selected gender indicator on the display device while the participant's vision is physically impaired. Each of the game participants, in turn, places a gender indicator on the display device in a similar manner. After placement of all the gender indicators, the gender of the baby is predicted by determining which gender indicator has been placed closest to a designated point on the display device. The predicted gender of the baby is the same as the gender represented by the gender indicator which has been placed closest to the designated point on the display device.

Another aspect of a preferred embodiment of the invention provides a game for foretelling what the gender of a baby will be by the placement of plurality of gender indicators on a display device by a plurality of game participants. The game includes a device for displaying a representation of a baby and a plurality of gender indicators for placement on the display device in various locations. Each of the gender indicators represent either the male or the female sex. The placement of the gender indicators on the display device acts to foretell what the gender of a baby will be.

It is an object of the invention to provide a highly entertaining method of foretelling particulars of a subject person, such as what the physical and personal characteristics of a baby will be.

Another object of the invention is to provide a fun and exciting game which invites the participation of all the guests.

It is a further object of the invention to provide a method of predicting particulars of a subject's future, such as what the birth date of a baby will be, or what the future profession of a person will be.

These and other objects, features, and advantages of the invention will be apparent from the detailed description of a preferred embodiment explained with reference to the figures, a brief description of which is set forth below.

DETAILED DESCRIPTION OF THE PREFERRED EMBODIMENT

One presently preferred embodiment of the invention is disclosed herein for purposes of explaining the apparatus and method comprising the invention. This preferred embodiment comprises a game and method for foretelling personal and future particulars of an individual, such as the gender and birth date of an unborn baby.

Figure 1:
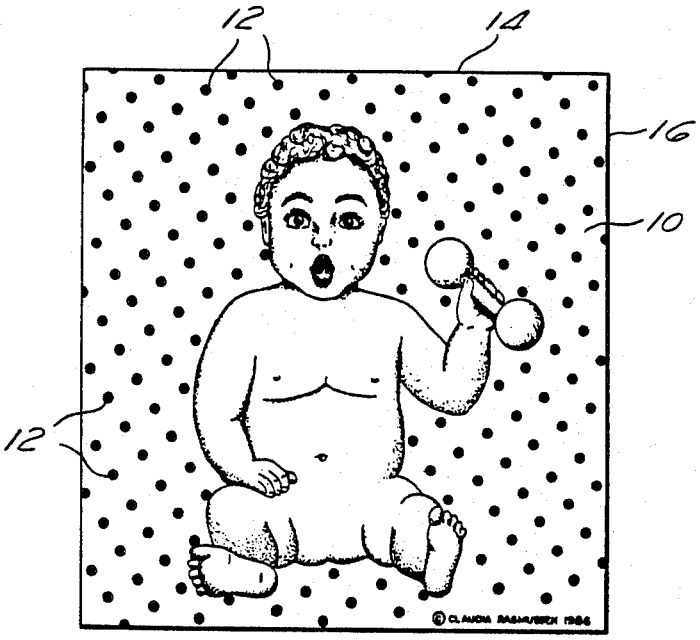
FIG. 1 is a display device having a representation of a baby thereon.

Specifically, a display device such as a poster 10 having a representation of a baby thereon is illustrated in FIG. 1. The baby is unclothed and neuter, that is, it does not exhibit sexual characteristics indicative of either gender. The baby is in a sitting position with its legs apart and has a surprised expression on its face. The illustration of the baby covers a significant portion of the poster 10. The background of the poster 10 is optionally covered by many polka dots 12 arranged in rows angled with respect to the borders 14, 16 of the poster 10. Of course, it is recognized that other backgrounds could be used just as effectively, and the position or expression of the baby could also be changed while still permitting appropriate use of the game. The poster 10, which is, in one preferred embodiment, approximately 24" wide and 27" in height, is preferably formed of flexible material which may be folded or rolled up. The flexible material has a surface which accepts ink from a felt marker, for example, to allow coloration of the poster 10 such as, for example, the baby's hair, eyes and skin tone. To further facilitate such coloration by the participants, the illustration of the baby initially comprises light hair, such as blonde, and light blue eyes with fair, caucasian skin. These colors can be easily changed through use of conventional coloring materials, such as crayons or paints, to numerous different and darker shades and/or colors.

Figure 2:
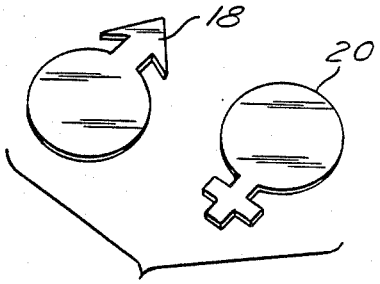
FIG. 2 is an illustration of a pair of gender indicators.

A male gender symbol 18 and a female gender symbol 20, are illustrated in FIG. 2. These gender symbols 18, 20 are preferably formed of paper stock and in one preferred embodiment are approximately 3 and $\frac{7}{8}$ inches in diameter. The female gender symbol 20 is preferably pink in color, while the male gender symbol 18 is preferably light blue. While only two gender symbols 18, 20 are shown in FIG. 2, many such gender symbols are utilized in this described embodiment. These gender symbols 18, 20 are individually placed on the poster 10 in accordance with a method for foretelling birth statistics of the baby such as whether the baby will be a boy or a girl and what the baby's birth date will be.

When this method is practiced at a party, such as a baby shower, each of the guests at the shower places one of the gender symbols 18, 20 on the poster 10 having the representation of the baby thereon while being visually impaired by means such as a blindfold. The baby's gender and birth date are predicted to be the gender and birth date indicated by the gender symbol which is placed on the poster 10 closest to the point between the legs of the neuter child at which the genital area would be.

This method is practiced in the following manner. Prior to or at the baby shower, the poster 10 may be colored to represent a prediction of the baby's physical coloring. For example, the baby's eyes might be colored green and the baby's hair brown. At the shower, the poster 10 is positioned, for example, by being attached to a wall in a manner such as a poster would be hung. Each of the participants selects one of the gender symbols 18, 20 representing either the male or the female gender, depending on whether the participant thinks the baby will be a boy or a girl. After choosing a gender symbol, each participant writes his or her name on the symbol in order to keep track of which participants place which symbols, and also to record the name of those who attended the shower. Each participant also preferably writes a predicted birth date on the gender symbol. After applying adhesive to the reverse side of the gender symbols, each participant, one by one, is designated and that participant's vision is impaired, for example, by placing a blindfold around his or her eyes. After the participant is blindfolded, the participant is repeatedly spun around in a circle, for example, three times, and then turned to face the poster 10. The participant then proceeds in the perceived direction of the poster 10, and attempts to place the gender symbol on the display at the location where it is believed that the genital area of the neuter baby would be. After the gender symbol is so placed, the participant's blindfold is removed and the participant is allowed to see where he or she placed the gender symbol.

The foregoing steps are repeated for each participant until all the participants have placed gender symbols on the poster 10. At this point, the gender and birth date of the baby are predicted by determining which gender indicator has been placed closest to the designated location between the neuter baby's legs. The predicted gender is the same as the gender represented by the gender symbol which has been placed closest to the designated location on the poster 10. The predicted birth date is the date that was written on that same gender symbol. This determination may be made by measurement or by visual inspection. If made by inspection, the background, such as polka dots 12, aids in the determination by providing a sense of distance since the dots are equally spaced within their angled rows.

Figure 3:
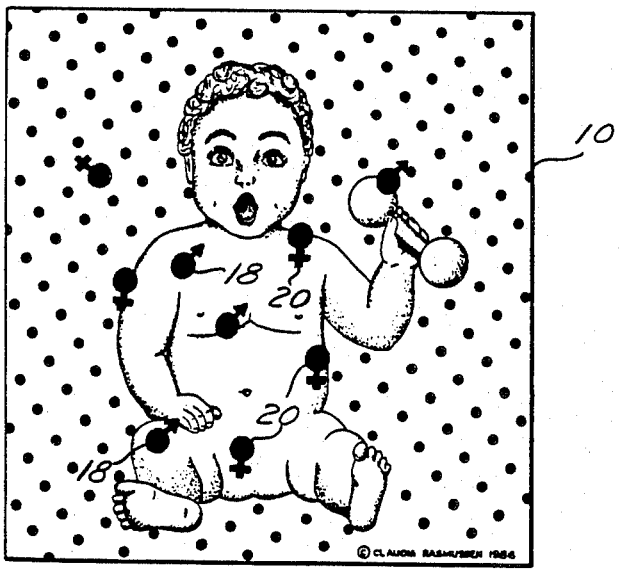
FIG. 3 is an illustration of the display device of FIG. 1 with a plurality of gender indicators placed thereon.

After the method is finished, the poster 10 appears similar to the poster 10 shown in FIG. 3, with a plurality of gender symbols 18, 20 attached at various points. Because the female gender symbol 20 has been placed closest to the designated point between the baby's legs, the baby is predicted to be a girl. The birth date of the baby is predicted to be the date that was written on this female gender symbol.

The poster 10 preferably includes a number of printed headings with blank lines (not shown), for example, "Date of Birth: ——," in which information about the baby and baby shower can be recorded. These headings may include, for example, "Mother's Name," "Date of Shower," "Place of Shower," "Game Winner," "Winner's Gender Prediction," "Winner's Birth Date Prediction," "Baby's Date of Birth," "Baby's Name," and "Baby's Outcome."

This method is a fun a highly entertaining way of foretelling whether a baby will be a boy or a girl and when the baby will be born. The attempted placement of the gender symbol between the illustrated baby's legs by the blindfolded participants is quite amusing and entertaining, especially in view of the surprised look on the illustrated baby's face. The method also invites each of the participants to guess what the baby's gender and birth date will be by selecting either a male gender symbol or a female gender symbol and writing the predicted birth date thereon, and it allows one of the participants to predict the gender and birth date of the baby by placing the gender symbol closest to the designated point. After the gender symbols 18, 20 are placed, the poster 10, which has the guests' names on the gender symbols, also represents a record of the baby shower, triggering fond memories of the shower and also indicating those that were present at the shower. The display can be preserved, for example, by framing.

While the invention has been described with reference to an embodiment in which a poster carries the illustration of the neuter baby, another type of display device or other illustration could be used and the benefits of the invention would be retained. Also, while the use of the male and female gender symbols has been described, other types of symbols or devices could be used for indicating gender or for indicating other characteristics or events in the practice of the invention. For example, symbols representing and/or including information predicting other particulars of the subject and his future such as birth weight, baby length, traits, interests, future accomplishments, profession, hobbies, and the like, could also be used in the practice of the invention.

As a specific example of other symbols which may be used, the talents of a baby could be predicted by participants selecting from among symbols representing musical instruments, sports equipment, literature, science, mathematics and the like. In another example, future circumstances such as the profession of a person could be predicted by providing a display comprising an illustration of a person with uncovered head, and by providing symbols in the form of various types of hats representing professions and trades such as fireman, doctor, pilot, businessman and the like. The future profession would be determined by the hat symbol position closest to a designated location on the illustrated child's head. The profession could be described in writing on the symbol, or an event such as date of college graduation could be predicted by a date written by the participant on the symbol.

Other modifications and alternative embodiments of the invention will be apparent to those skilled in the art in view of the foregoing description. Accordingly, this description is to be construed as illustrative only, and is for the purposes of teaching those skilled in the art the best mode of the invention. The details of the described embodiment may be varied substantially without departing from the spirit of the invention, and the exclusive use of all modifications which come within the scope of the following claims is reserved.

What is claimed is:

1. A game for foretelling what the gender of a baby will be by the placement of a plurality of different types of gender indicators on a game poster by a plurality of game participants, said game comprising:

a game poster having a representation of a baby thereon; and a plurality of first gender indicators attachable to said game poster at a plurality of different locations, each of said first gender indicators representing the female sex; and a plurality of second gender indicators attachable to said game poster at a plurality of different locations, each of said second gender indicators representing the male sex, the placement of said first and said second gender indicators on said game poster determining what the predicted gender of a baby will be, based upon the distances of said gender indicators from a designated location on said game poster.

2. A game as defined in claim 1, wherein said first and second gender indicators are the gender symbols for the female and male genders, respectively.

3. A game as defined in claim 1, wherein said game poster includes a location for recording information about a baby.

4. A game as defined in claim 1, additionally comprising means for attaching said gender indicators to said game poster.

5. A game as defined in claim 1, wherein the gender indicator which is placed nearest to the designated location on said game poster determines what the predicted gender of the baby will be.

6. A game as defined in claim 5, wherein the designated location on said game poster lies between the legs of the baby.

7. A game as defined in claim 1, wherein the gender indicators include means for indicating a predicted date of the baby's birth.

8. A game as defined in claim 7, wherein the gender indicator which is placed nearest to the designated location on said game poster determines what the predicted gender and date of birth for the baby will be.

9. A method of foretelling what the gender of a baby will be by the placement of a plurality of gender indicators on a display means by a plurality of participants, said method comprising the steps of:

(a) positioning a display device having a representation of a baby thereon;

(b) selecting a gender indicator from a plurality of gender indicators, said gender indicators including a first type representing the female gender and a second type representing the male gender;

(c) placing the selected gender indicator on said display device while the vision of the person placing the gender indicator is impaired;

(d) repeating said steps (b) and (c) for a plurality of participants;

(e) foretelling what the gender of the baby will be by determining which type of gender indicator has been placed closest to a designated location on said display device, the predicted gender of the baby being the same as the gender represented by the type of gender indicator which was placed closest to the designated location on said display device; and (f) predicting what the birth date of a baby will be by having each participant write a birth date on one of said gender indicators, the predicted birth date being the same as the date that was written on the gender indicator which is placed closest to the designated location on said display device.

10. A method of foretelling what the gender of a baby will be by the placement of a plurality of gender indicators on a display means by a plurality of participants, said method comprising the steps of:

(a) positioning a display device having a representation of a baby thereon;

(b) selecting a gender indicator from a plurality of gender indicators, said gender indicators including a first type representing the female gender and a second type representing the male gender, said gender indicators being the gender symbols for the male and female genders;

(c) placing the selected gender indicator on said display device while the vision of the person placing the gender indicator is impaired;

(d) repeating said steps (b) and (c) for a plurality of participants;

(e) foretelling what the gender of the baby will be by determining which type of gender indicator has been placed closest to a designated location on said display device, the predicted gender of the baby being the same as the gender represented by the type of gender indicator which was placed closest to the designated location on said display device; and (f) writing the name of a participant on the gender symbol selected by the participant.

11. A game for foretelling particulars of a subject by the placement of a plurality of indicators on a display device by a plurality of game participants, said game comprising:

a device for displaying an illustration of a baby thereon;

a plurality of indicators for placement on said display device in various locations, each of said indicators representing predicted particulars of the subject, the placement of said indicators on said device acting to foretell particulars of the subject, based upon the distances of said indicators from a designated location on said display device; and means on said display device for providing a sense of distance to aid in the determination of which of said indicators was placed closest to a designated location on said display device.

12. A game as defined in claim 11, wherein said display device includes a location for recording information about a baby.

13. A game as defined in claim 12, additionally comprising means for attaching said indicators to said display device.

14. A method of foretelling what the gender of a baby will be by the placement of a plurality of gender indicators on a display means by a plurality of participants, said method comprising the steps of:

(a) positioning a display device having a representation of a baby thereon;

(b) selecting a gender indicator from a plurality of gender indicators, each of said gender indicators representing either the male or the female gender;

(c) placing the selected gender indicator on said display device while the vision of the person placing the gender indicator is impaired;

(d) repeating said steps (b) and (c) for a plurality of participants;

(e) foretelling what the gender of the baby will be by determining which gender indicator has been placed closest to a designated location on said display device, the predicted gender of the baby being the same as the gender represented by the gender indicator which was placed closest to the designated location on said display device; and (f) predicting what the birth date of the baby will be by having each participant write a birth date on one of said gender indicators, the predicted birth date being the same as the date that was written on the gender indicator which is placed closest to the designated location on said display device

* * * * *